US006315657B1

(12) United States Patent
Schmidt

(10) Patent No.: US 6,315,657 B1
(45) Date of Patent: Nov. 13, 2001

(54) AIR OUTLET GRILLE WITH LOUVER INDEXING ADJUSTMENT MEANS

(75) Inventor: Donald James Schmidt, Winnipeg (CA)

(73) Assignee: E. H. Price Limited, Winnipeg (CA)

( * ) Notice: Subject to any disclaimer, the term of this patent is extended or adjusted under 35 U.S.C. 154(b) by 0 days.

(21) Appl. No.: 09/490,451

(22) Filed: Jan. 24, 2000

(51) Int. Cl.[7] ..... F24F 13/075
(52) U.S. Cl. ..... 454/320; 454/313
(58) Field of Search ..... 454/155, 202, 454/299, 315, 320, 332

(56) References Cited

U.S. PATENT DOCUMENTS

| | | | | |
|---|---|---|---|---|
| 2,236,865 | | 4/1941 | Bailey et al. . | |
| 2,254,258 | * | 9/1941 | Perkins . | |
| 2,759,410 | | 8/1956 | Hurt, Jr. . | |
| 2,991,707 | | 7/1961 | Goettl . | |
| 3,012,494 | | 12/1961 | Drummond . | |
| 3,176,603 | | 4/1965 | O'Day, et al. . | |
| 3,180,246 | | 4/1965 | Johnson . | |
| 3,270,657 | | 9/1966 | Jaye . | |
| 3,735,691 | * | 5/1973 | Gofton et al. . | |
| 3,786,738 | | 1/1974 | Fahre . | |
| 3,996,845 | | 12/1976 | Harris . | |
| 4,545,294 | * | 10/1985 | Dayus . | |
| 5,338,252 | | 8/1994 | Bowler et al. | 454/155 |
| 5,470,276 | | 11/1995 | Burnell et al. . | |
| 5,586,933 | | 12/1996 | Sawyer et al. . | |
| 5,626,517 | | 5/1997 | Kil . | |
| 5,788,570 | | 8/1998 | Cho . | |

FOREIGN PATENT DOCUMENTS

| | | | | |
|---|---|---|---|---|
| 61-83839-A | * | 4/1986 | (JP) | 454/155 |

* cited by examiner

*Primary Examiner*—Harold Joyce
(74) *Attorney, Agent, or Firm*—Ridout & Maybee

(57) ABSTRACT

A louver indexing device for air flow directional grilles is disclosed which allows for enhanced reliability of the indexing function, a wider selection of materials and less critical manufacturing tolerances. The end of each louver slides across an indexing plate as the blade rotates. The indexing plate is a resilient separate component from either the louver or the housing frame and is connected to both by simple screw fastener means.

5 Claims, 2 Drawing Sheets

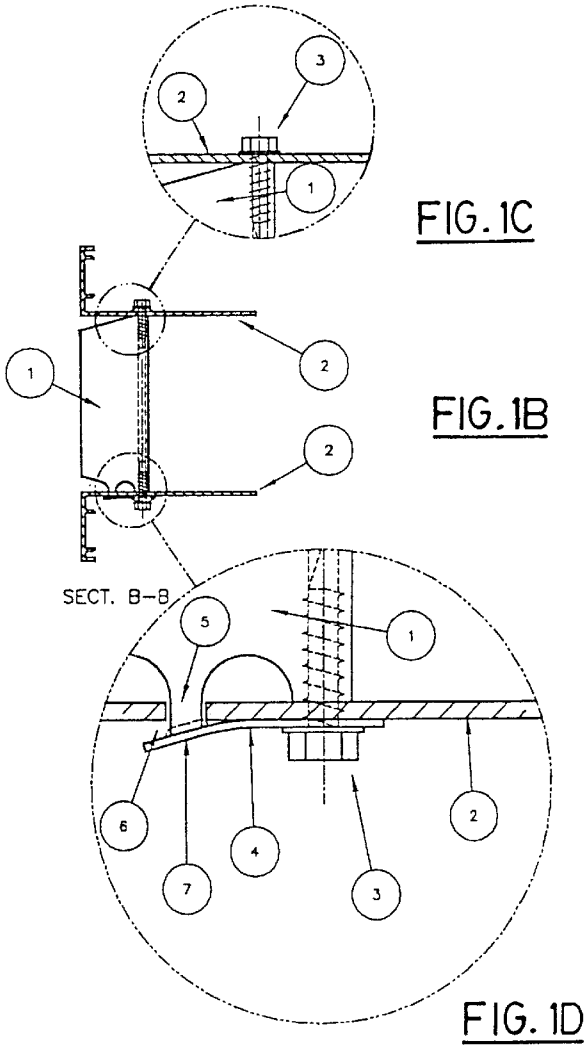
FIG. 1C
FIG. 1B
FIG. 1D
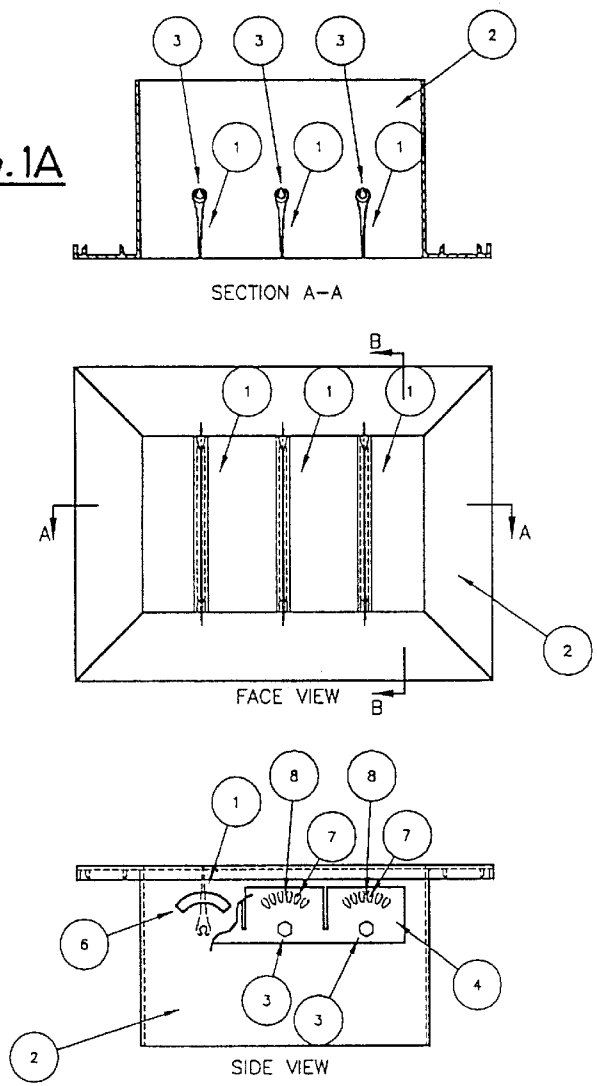
FIG. 1A
FIG. 1
FIG. 2

A
A
1
2
3
9
10
11
11
13
SIDE VIEW
(PARTIALLY EXPLODED)

1
9
10
12
SECTION A-A 9
13
14
14
MULLION A
SCALE 2:1

AIR OUTLET GRILLE WITH LOUVER INDEXING ADJUSTMENT MEANS

BACKGROUND OF THE INVENTION

1. Field of the Invention

This invention relates to an air inlet grille having airflow director blades (louvers) and more particularly to novel indexing means for controlling the position of those louvers.

2. Description of the Prior Art

Air distribution devices have long been available, which are characterized by adjustable louvers. These differ among themselves as to (i) the means for directionally adjusting the louvers and/or (ii) the manner for temporarily retaining one or more of the louvers in a selected directional orientation.

Louver directional adjustment is typically accomplished by rotating the louver on an axis parallel to the long dimension of the louver. Louvers typically have one pivot point at each end and are retained at this pivot point in the grille frame. Typical methods for providing the pivot point for a louver include a portion of the louver extending through a hole in the frame, or a screw or other fastener means driven through a hole in the frame and into the louver.

Louvers may be adjusted individually, or by acting on two or more louvers at once ("gang operated" louvers). Individually adjustable louvers have the potential advantage of more precise air flow control, since each louver can be adjusted to its optimal position. On the other hand, gang operated louvers can be more convenient to adjust, as the one adjustment controls several or all of the louvers in a grille. Often, gang operated louvers are worked by a linkage which can be accessed more conveniently than could the louvers individually.

Known air distribution devices typically retain the louvers in a selected position by means of frictional engagement and/or an indexing device.

The most common method for retaining louvers is with friction. Relatively smooth surfaces are in contact and resist sliding, owing to the coefficient of friction and clamping forces between the two parts. Examples of this kind include the use of wire against a round louver end pivot (U.S. Pat. No. 2,991,707 Goettl); a flat spring-loaded surface pressing against a parallel flat planar surface of a louver (U.S. Pat. No. 3,180,246 Johnson); a spring-loaded screw end pressing against a cylinder attached to the end of a louver (U.S. Pat. No. 2,236,865 Bailey et al); or a spring-loaded expandable round pivot point on the grille fitted into a hole on the frame (U.S. Pat. No. 3,270,657 Jaye). Since grilles are typically manufactured from materials that are hard and smooth (e.g. metal or plastic) they inherently have a low coefficient of friction. Louvers retained in a set direction only by the resistance of sliding friction between two components may not be capable of withstanding forces that unintentionally cause the louver to rotate into an undesired orientation.

The second method for retaining louvers in a given position employs an indexing device. The sliding surfaces between the rotating louver and a fixed point on the grille (for example, the frame) are provided with geometric features which are intended to increase the resistance to adjustment of the louver direction from certain selected positions.

One typical method of louver indexing uses a wire spring pressing against a square or rectangular section of the louver end. The square or rectangular section of the louver end is approximately at the pivot point around which the louver rotates. As it does so, the louver will naturally rest in a position where the spring rests flat against one side of the square or rectangular section of the louver as exemplified in U.S. Pat. No. 2,759,410 (Hurt, Jr.). In this arrangement, however, if a louver is adjusted away from its resting point it may unexpectedly adjust back to the resting point when vibrated, thus limiting the range of reliable settings for the louver.

A second indexing method employs a leg integral to the louver, acting as spring as the louver is rotated across undulations in the frame as illustrated, for example, in U.S. Pat. Nos. 5,338,252 (Bowler et al.) and 5,626,517 (Kil). Such an arrangement requires the louver material to be capable of acting resiliently, so limiting the choice of materials from which the louvers may be fabricated.

It is a principal object of the present invention to provide a new louver indexing device for grilles which exhibits a high degree of reliability and reproducibility of the indexing function.

It is a further object of the invention to provide indexing means giving distinct tactile feedback to a person adjusting a louver to any of a selected number of discrete angular positions.

It is a further object of the invention to provide indexing means which resists accidental louver repositioning by reason of vibration, airflow force or other loads.

It is a still further object of the invention to provide louver indexing means which may be used with louvers fabricated from a wide range of structural materials.

SUMMARY OF THE INVENTION

With a view to achieving the aforementioned objects and overcoming the disadvantages of the prior art, the present invention provides a novel louver indexing device for grilles in which an indexing plate is a resilient separate component from either of the louver of the frame, allowing for a wide choice of materials for the louver, frame and indexing plate.

An air outlet grille according to the present invention comprises a rectangular housing of frame members, a series of parallel louver blades pivotably connected at opposite ends to the frame members by screw means and resilient indexing means. Preferably, this comprises a spring plate with angularly disposed arcuate projections that engage with a rear projection on the louver blade itself. The projections are configured so that the rest positions of the louver blade are at 0, 15, 30 or 45° from parallel with the air flow.

A screw or other fastener connects the louver, frame and indexing plate. By keeping the louver in contact with the indexing plate using a fastener, small variations in the louver length and/or frame straightness become acceptable, contributing to more economical manufacture and more reliable operation of the louver indexing device, because frame straightness is not as critical as in prior art arrangements, less rigid frames can be employed for more economical manufacture, or longer frames (unless larger grilles) can be produced which still have reliable louver indexing.

BRIEF DESCRIPTION OF THE DRAWINGS

In the description which follows, reference may be made to the accompanying drawings, in which:

FIG. 1 is a front plan view of a grille constructed according to the present invention;

FIG. 1A is a cross-sectional view of the grille of FIG. 1, seen in the direction of arrows A—A;

FIG. 1B is a cross-section al view of the grille of FIG. 1, seen in the direction of arrows B—B, FIG. 1C is an enlarged view of the positions at which a louver blade is connected to the frame of the grille at the upper end thereof, FIG. 1D is an enlarged view of the positions at which a louver blade is connected to the frame of the grille at the lower end thereof;

FIG. 2 is a side elevational view of the grille of FIG. 1;

BRIEF DESCRIPTION OF THE PREFERRED EMBODIMENT

Figure 3:
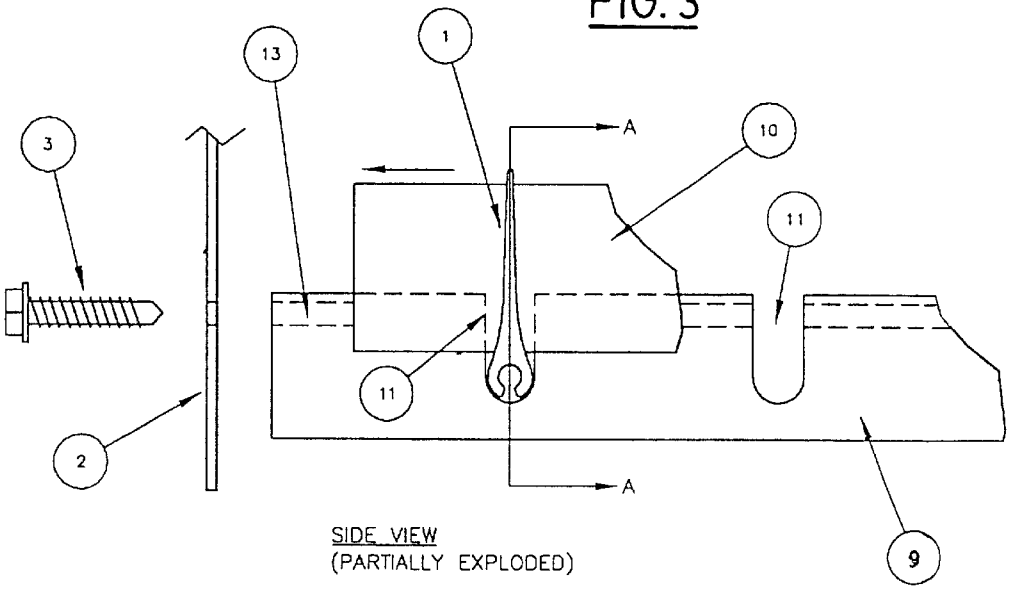
FIG. 3 is a partially exploded side view of a preferred embodiment of the invention, in which the louver blades are separated between the respective ends by mullions of a unique two-part construction.

A grille according to the present invention is comprised of one or more arrays of parallel blades 1 held by a frame 2. Blades are attached to the frame with screws 3 at both ends of the blade, allowing the blades to pivot into positions for deflecting airflow.

Optionally, mullions may be used to support an array of blades at intervals between the blade ends. A particularly useful and unique mullion design is described further below in connection with FIGS. 3, 3A and 4.

Spring means 4 is incorporated into the grille, which allows a louver blade 1 to be pivoted to a discrete number of positions. While the spring means for this purpose may be of any material (metal, plastic) or design (leaf, coil, etc.) or shape (planar, bushing, wire), in the depicted embodiment a spring plate 4 is attached to the outside of the frame with the same screws 3 used to fasten the blade 1 at one end thereof. Blades 1 are provided with a projection 5 that fits through a slot 6 in the frame and contacts the spring plate. As the blade swings through its arc, the projections 5 on the blade ride over raised sections 7 on the spring plate. The blade resists being positioned directly over raised sections on the spring plate since in that position there is additional compression of the spring plate. The blade will naturally position (index) itself in the valleys 8 intermediate the projections on the spring plate and will resist moving from its position there.

The above indexing feature provides tactile feedback to the person adjusting the blade as the blade is moved and helps to avoid accidental blade repositioning by reason of vibration, or the force of air flow. The blade indexes into position at angles 0, 15, 30 and 45° from parallel with the supply air flow, in both clockwise and counterclockwise directions. The frame slot for the blade end projection is shaped to prevent blade 1 from turning more than 45°. This is intended to prevent blade failures as allowing the blade to turn past 45° could result in a buildup of excessive static pressure and turbulence. Turbulence under high air flow conditions (up to 1800 feet per minute) could result in blade failure.

Figure 3A:
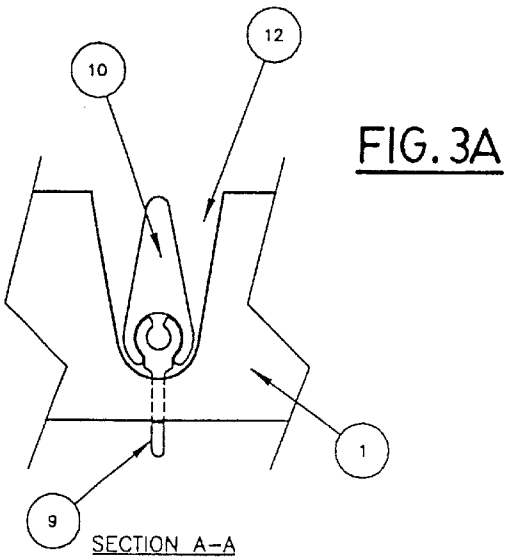
FIG. 3A is a cross-sectional view of the components in FIG. 3, seen in the direction of the arrows A—A.
Figure 4:
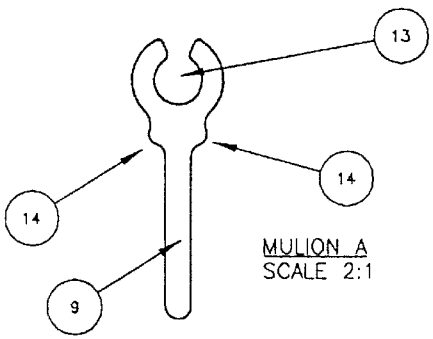
FIG. 4 is an isolated enlarged view of one of the two parts of a mullion used in the embodiment of FIGS. 3 and 3A.

As may best be seen in FIGS. 3, 3A and 4, in a preferred embodiment of the invention, one or more mullions 9/10 are used on longer blades 1 to provide support between the ends of the blade. The mullion captures and supports each blade in an array of parallel blades. Mullions are positioned in the same plane as the array of blades, running in a direction perpendicular to the blades.

Each mullion is made up of two parts, 9 and 10. Mullion parts 9 and 10 have a relatively uniform cross section along their length. Mullion part 9 has slots 11 perpendicular to its length, into which the blades 1 fit. These slots are places at regular intervals to separate blades at constant blade spacing. Mullion 10 slide over and around mullion 9. The blades are formed with notches 12 to allow each mullion part 10 to pass over them. Once mullion part 10 has been slid into place over the blades and mullion part A, the blades are then locked into the mullion assembly but are still free to rotate.

Mullion part 10 has a thicker cross section which imparts strength to the mullion assembly. Mullion part 9 has a screw chase 13 along its length, which allows the Mullion assembly to be mounted to the frame with screws 3 and which serves to reduce the amount of material in mullion part 9, thereby bringing costs down. There is a small amount of clearance between mullion parts 9 and 10 to allow mullion part 10 to slide over mullion part 9. When the screw 3 is driven into mullion part 9 to mount the mullion assembly to the frame, part 9 expands against part 10 thereby locking the two components of the mullion together.

The mullion assembly is also shaped aerodynamically to reduce static pressure, turbulence and noise as air passes over it. Ribs 14 along mullion part 9 prevent relative rotation between mullion part 9 and mullion part B to keep the mullion assembly from binding on the blades 1 as they rotate and maintain the assembly in the least restrictive direction to the airflow.

In manufacturing the embodiment of grille including this mullion assembly, mullion part 9 and mullion part 10 are first cut to length. Slots are then punched in mullion part 9 at regular intervals and the louver blades 1 are notched at appropriate regular intervals. The blades are screwed into the frame ends of the sides and mullion part 9 is laid into the blade notches then mullion part 10 is slid down over mullion part A. The remaining frame sides or ends are fitted together and the corners staked, then screws are driven into mullion parts 9 to secure the assembly. The resulting mullion design simplifies assembly of the mullions to the blades and frames, thereby contributing to a more economical manufacture of the grille.

While a preferred embodiment has been described, one of ordinary skill in the art would appreciate that alterations could be made to apparatus answering to the invention without departing from the fundamental concept thereof.

As noted above for example, the spring element might advantageously be made of various materials (metal, plastic) or shape. The spring indexing mechanism need not act on each blade individually but could include linkage to act on groups of blades together. In other designs, the "lower" mullion 10 might be configured to slide over mullion 9 rather than the reverse and the mullion assembly as a whole might be attached to the frame by fastening means other than screws. The scope of the invention is defined in the claims which follow.

What is claimed is:

1. An air outlet grille for controlling the direction of air flow therethrough, comprising:

a housing of rectangularly disposed frame members;

a series of parallel louver blades, each pivotably connected to opposed inward faces of frame members at opposite ends of the blade by first attachment means for rotation of the blades about parallel axis of rotation;

resilient indexing means connected to said housing by second attachment means for releasable retention of said louvers at selected rotational displacement, comprising at least one spring means having an arcuately disposed plurality of inwardly directed convex projections, at least one of said louver blades including on the rear edge thereof an outwardly projection configured to bear against successive means whereby said outwardly convex projections of the spring of said at least one louver blade is rotatably adjusted.

2. An air outlet grille according to claim 1, wherein said first attachment means and said second attachment means comprise a screw through the frame and into the end of said at least one louver blade.

3. An air outlet grille according to claim 2, wherein said spring means is a spring plate attached to the outward face of said frame member and said frame member includes a slot to allow passage therethrough of said outwardly convex projection on said at least one louver blade.

4. An air outlet grille according to claim 3, wherein said projections on said spring plate are so disposed to index the associated louver blade into positions at 0, 15, 30 or 45° from parallel with the supply air flow.

5. An air outlet grille according to claim 4, wherein said slot through the frame member is shaped to prevent said louver blade from being turned by more than 45°.

* * * * *